US006637396B2

(12) United States Patent
Katayama

(10) Patent No.: US 6,637,396 B2
(45) Date of Patent: Oct. 28, 2003

(54) AIR INDUCTION SYSTEM FOR MULTI-CYLINDER ENGINE

(75) Inventor: Goichi Katayama, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/050,380

(22) Filed: Oct. 26, 2001

(65) Prior Publication Data

US 2002/0144669 A1 Oct. 10, 2002

(30) Foreign Application Priority Data

Oct. 26, 2000 (JP) ..... 2000-327063

(51) Int. Cl.[7] ..... F02M 35/10
(52) U.S. Cl. ..... 123/184.42
(58) Field of Search ..... 123/184.42, 184.43, 123/585, 184.47, 184.48, 184.34, 184.24, 184.21, 184.53, 184.35, 184.44, 195 P

(56) References Cited

U.S. PATENT DOCUMENTS 4,653,440 A * 3/1987 Fukuhara et al. ..... 123/184.53
4,794,885 A * 1/1989 Honda et al. ..... 123/184.43
5,743,228 A 4/1998 Takahashi
5,829,402 A 11/1998 Takahashi et al.
6,019,083 A 2/2000 Isogawa
6,030,262 A 2/2000 Okamoto et al.

FOREIGN PATENT DOCUMENTS

JP 11-34985 2/1999

* cited by examiner

*Primary Examiner*—Henry C. Yuen
*Assistant Examiner*—Hyder Ali
(74) *Attorney, Agent, or Firm*—Knobbe, Martens, Olson & Bear LLP.

(57) ABSTRACT

An engine includes an engine body and four pistons reciprocally moveable relative to the engine body. The engine body and the pistons together define four combustion chambers. An air induction system is arranged to introduce air into the combustion chambers. The air induction system includes four intake passages corresponding to the respective combustion chambers. A plenum chamber is coupled with the intake passages. The air is delivered to each combustion chamber from the plenum chamber through each intake passage in due order. The plenum chamber is divided into first and second sub-chambers. The intake passages are categorized into first and second groups. Each group includes two of the intake passages which have discontinuity in the order with each other. The first group is connected with the first sub-chamber. The second group is connected with the second sub-chamber.

23 Claims, 9 Drawing Sheets

AIR INDUCTION SYSTEM FOR MULTI-CYLINDER ENGINE

PRIORITY INFORMATION

This application is based on and claims priority to Japanese Patent Application No. 2000-327063, filed Oct. 26, 2000, the entire contents of which is hereby expressly incorporated by reference.

BACKGROUND OF THE INVENTION

1. Field of the Invention

The present invention relates generally to an air induction system for a multi-cylinder engine, and more particularly to an improved air induction system that includes a plenum chamber to which multiple intake passages are connected.

2. Description of Related Art

A multi-cylinder engine typically has an air induction system including multiple intake passages that introduce air into multiple combustion chambers of the engine. Typically, the air is delivered to each combustion chamber through each intake passage in due order because each combustion cycle per cylinder occurs sequentially one by one. In some arrangements, the intake passages are coupled with a plenum chamber disposed upstream thereof. The plenum chamber primarily is used to coordinate airflow delivered to the combustion chambers through the separate intake passages.

The combustion chambers typically are formed with an engine body and pistons reciprocally disposed relative to the engine body. Normally, a valve mechanism controls the air introduction to the combustion chambers. For example, intake valves are disposed to move between an open position in which the combustion chambers are connected with the associated intake passages and a closed position in which the combustion chambers are disconnected with the associated intake passages.

In general, the movement of each piston toward a crankcase generates negative pressure. The negative pressure makes a negative pressure draws the air in the plenum chamber to the combustion chamber. Theoretically, the negative pressure makes a negative pressure wave that proceeds upstream to a free edge, e.g., a connecting portion with the plenum chamber and is reflected at the free edge. At the moment of the reflection, the negative pressure wave alters itself to a positive pressure wave and proceeds downstream to the combustion chamber. If this positive pressure wave returns to the combustion chamber at the end of the intake stroke, a large quantity of air can be charged into the combustion chamber. That is, the positive pressure wave advantageously increases the charging efficiency of the engine. The effective positive pressure wave is an inertia wave. If, at the moment when the positive pressure wave returns to the combustion chamber, the intake valve is in the closed position, the wave, still as the positive pressure wave, is reflected at the intake valve, i.e., a built-in edge, and proceeds upstream to the free edge again. This reciprocal movement of the positive pressure wave repeats between the combustion chamber and the plenum chamber. The phenomenon is a columnar vibration and the wave is a pulsation wave. The columnar vibration gradually is attenuated. If this columnar vibration is still alive until the next intake stroke of another cylinder starts and the positive pressure wave can act as the inertia wave to this intake stroke, the wave can further improve the charging efficiency of the engine.

If, however, the positive pressure wave that has been generated in the previous intake stroke of one cylinder moves back to the plenum chamber at the moment the next intake stroke of another cylinder starts, the wave can inhibit the air from moving forward. The positive pressure wave in this phase is not a useful pulsation wave and can make an undesirable valley in the engine torque characteristic. This detrimental fluctuation can occur in the engine torque characteristic per every intake stroke.

SUMMARY OF THE INVENTION

Engines constructed in accordance with the preferred embodiments of the invention provide an improved air induction system for a multi-cylinder engine that improves the engine torque characteristic. A significant feature of the preferred embodiment is that the positive pressure wave created by a previous intake stroke does not inhibit the airflow during the intake stroke of the next-to-fire cylinder.

In accordance with one aspect of the present invention, an internal combustion engine comprises an engine body. A plurality of moveable members are moveable relative to the engine body. The engine body and the moveable members together define a plurality of combustion chambers. An air induction system is arranged to introduce air into the combustion chambers. The air induction system includes a plurality of intake passages corresponding to the respective combustion chambers. A plenum chamber is coupled with the intake passages. The air is delivered to each one of the combustion chambers from the plenum chamber through each one of the intake passages in due order. The plenum chamber is divided into two sub-chambers. The intake passages are respectively connected to the two sub-chambers so that air is alternately delivered from the two sub-chambers to the combustion chambers to avoid the previous pressure wave interfering with the forward flow of air to the combustion chamber that is next in firing sequence.

In accordance with another aspect of the present invention, an internal combustion engine comprises an engine body. At least four moveable members are moveable relative to the engine body. The engine body and the moveable members together define at least four combustion chambers. An air induction system is arranged to introduce air into the combustion chambers. The air induction system includes at least four intake passages corresponding to the respective combustion chambers. A plenum chamber is coupled with the intake passages. The air is delivered to each one of the combustion chambers from the plenum chamber through each one of the intake passages in due order. The plenum chamber is divided into first and second sub-chambers. The intake passages are categorized into first and second groups. Each one of the groups includes two of the intake passages which have discontinuity in the order with each other. The first group is connected with the first sub-chamber. The second group is connected with the second sub-chamber.

In accordance with a further aspect of the present invention, an internal combustion engine comprises an engine body. A plurality of moveable members are moveable relative to the engine body. The engine body and the moveable members together define a plurality of combustion chambers. An air induction system is arranged to introduce air into the combustion chambers. The air induction system includes a plurality of intake passages corresponding to the respective combustion chambers. First and second plenum chambers are coupled with the intake passages. The air is delivered to each one of the combustion chambers through each one of the intake passages in due order. The intake passages are categorized into first and second groups. Each one of the groups includes the intake passages which have discontinuity in the order with each other. The first group is connected with the first plenum chamber. The second group is connected with the second plenum chamber.

In accordance with a still further aspect of the present invention, an air intake method is provided for a multi-cylinder engine that has first and second plenum chambers, and at least two intake passages, per each one of the first and second plenum chambers, that connect the first and second plenum chambers with respective cylinders of the engine. The method comprises delivering air to one of the cylinders from the first plenum chamber, delivering air to another one of the cylinders from the second plenum chamber, and delivering air to a further one of the cylinders from the first plenum chamber.

BRIEF DESCRIPTION OF THE DRAWINGS

These and other features, aspects and advantages of the present invention will now be described with reference to the drawings of preferred embodiments, which embodiments are intended to illustrate and not to limit the present invention. The drawings comprise ten figures.

DETAILED DESCRIPTION OF THE PREFERRED EMBODIMENTS OF THE INVENTION

The Overall Construction

Figure 1:
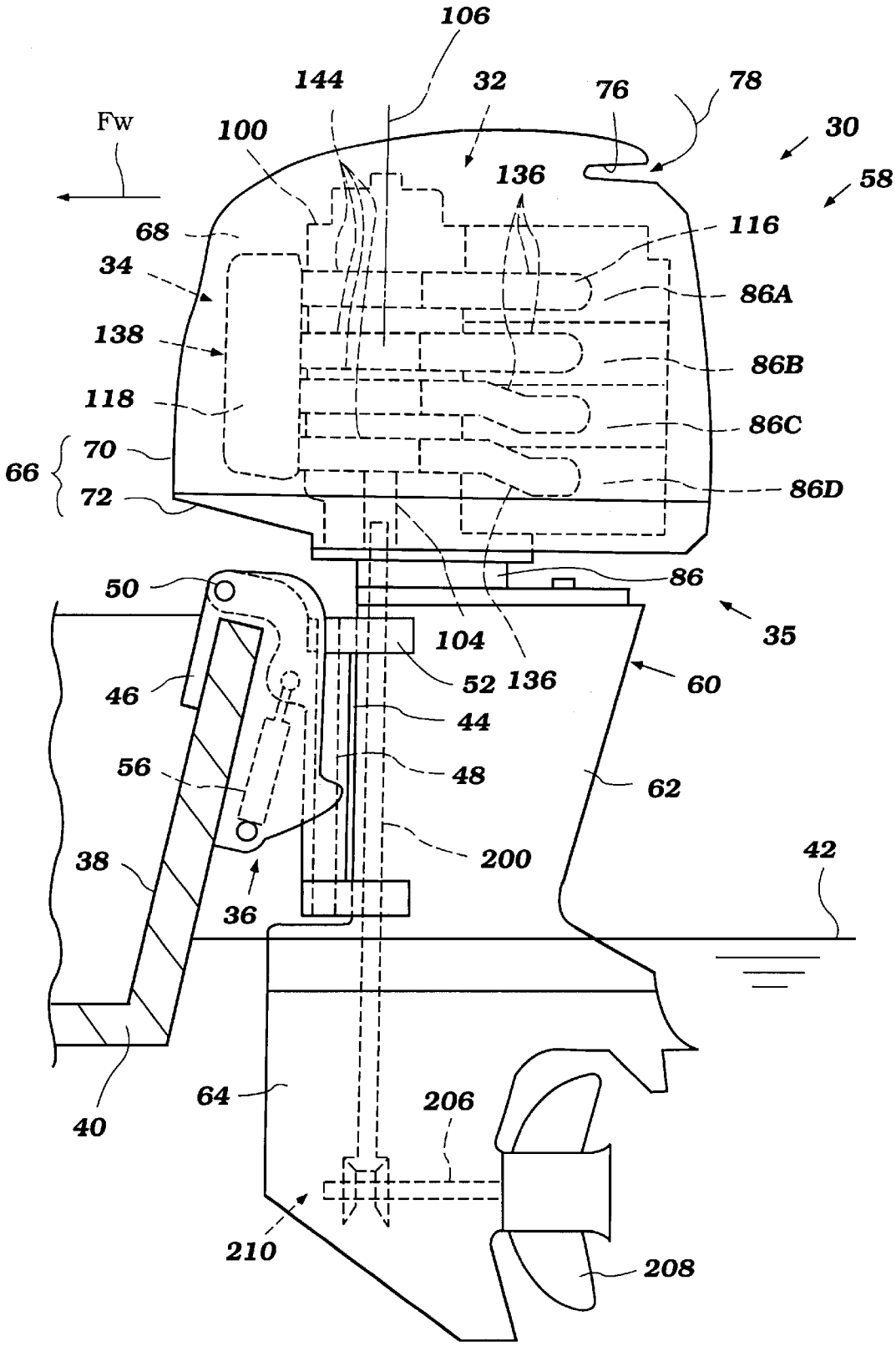
FIG. 1 is a side elevation view of an outboard motor employing an engine that has an air induction system configured in accordance with a preferred embodiment of the present invention. An associated watercraft is partially shown in section.

With primary reference to FIGS. 1 and 2 and additional reference to FIG. 3, an overall construction of an outboard motor 30 that employs an internal combustion engine 32 having an air induction system 34 configured in accordance with certain features, aspects and advantages of the present invention will be described. The engine 32 has particular utility in the context of a marine drive, such as an outboard motor for instance, and thus is described in the context of an outboard motor. The engine 32, however, can be used with other types of marine drives (i.e., inboard motors, inboard/outboard motors, etc.) and also certain land vehicles, which includes lawnmowers, motorcycles, go carts, all terrain vehicles and the like. Furthermore, the engine 32 can be used as a stationary engine for some applications that will become apparent to those of ordinary skill in the art.

In the illustrated arrangement, the outboard motor 30 generally comprises a drive unit 35 and a bracket assembly 36. The bracket assembly 36 supports the drive unit 35 on a transom 38 of an associated watercraft 40 and places a marine propulsion device in a submerged position with the watercraft 40 resting relative to a surface 42 of a body of water. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 35 by top and bottom mount assemblies 52. The steering shaft 48 is pivotally journalled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 35 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context use. The arrows Fw of FIGS. 1–3 indicate the forward direction. The terms "rear," "reverse," "backwardly" and "rearwardly" mean at or to the opposite side of the front side.

A hydraulic tilt and trim adjustment system 56 preferably is provided between the swivel bracket 44 and the clamping bracket 46 for tilt movement (raising or lowering) of the swivel bracket 44 and the drive unit 35 relative to the clamping bracket 46. Otherwise, the outboard motor 30 can have a manually operated system for tilting the drive unit 35. Typically, the term "tilt movement", when used in a broad sense, comprises both a tilt movement and a trim adjustment movement.

The illustrated drive unit 35 comprises a power head 58 and a housing unit 60, which includes a driveshaft housing 62 and a lower unit 64. The power head 58 is disposed atop the housing unit 60 and includes the engine 32 that is positioned within a protective cowling assembly 66, which preferably is made of plastic. In most arrangements, the protective cowling assembly 66 defines a generally closed cavity 68 in which the engine 32 is disposed. The engine 32, thus, is generally protected from environmental elements within the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic or repairperson can access the engine 32 for maintenance or for other purposes. In some arrangements, the top cowling member 70 is hingedly attached to the bottom cowling member 72 such that the top cowling member 70 can be pivoted away from the bottom cowling member for access to the engine 32. Preferably, such a pivoting allows the top cowling member 70 to be pivoted about the rear end of the outboard motor 30, which facilitates access to the engine 32 from within the associated watercraft 40.

The top cowling member 70 preferably has a rear intake opening 76 defined through an upper rear portion. A rear intake member with one or more air ducts is unitarily formed with or is affixed to the top cowling member 70. The rear intake member, together with the upper rear portion of the top cowling member 70, generally defines a rear air intake space. Ambient air is drawn into the closed cavity 68 via the rear intake opening 76 and the air ducts of the rear intake member as indicated by the arrow 78 of FIG. 1. Typically, the top cowling member 70 tapers in girth toward its top surface, which is in the general proximity of the air intake opening 76. The taper helps to reduce the lateral dimension of the outboard motor, which helps to reduce the air drag on the watercraft 40 during movement.

The bottom cowling member 72 preferably has an opening through which an upper portion of an exhaust guide member 80 extends. The exhaust guide member 80 preferably is made of aluminum alloy and is affixed atop the driveshaft housing 62. The bottom cowling member 72 and the exhaust guide member 80 together generally form a tray. The engine 32 is placed onto this tray and can be affixed to the exhaust guide member 80. The exhaust guide member 80 also defines an exhaust discharge passage through which burnt charges (e.g., exhaust gases) from the engine 32 pass.

The engine 32 in the illustrated embodiment preferably operates on a four-cycle combustion principle. With reference now to FIG. 2, the presently preferred engine 32 has a cylinder block 84 defining four cylinder bores 86. The cylinder bores 86 extend generally horizontally along a longitudinal center plane 88 extending vertically and fore to aft of the outboard motor 30, and are generally vertically spaced from one another. The illustrated engine 32 thus is a four-cylinder, in-line type engine. The cylinder bores 86 may represent the cylinders in the context of this description. For convenience sake, the cylinders are numbered 86A, 86B, 86C and 86D top to bottom (FIG. 1).

As used in this description, the term "horizontally" means that the subject portions, members or components extend generally in parallel to the water surface 42 (i.e., generally normal to the direction of gravity) when the associated watercraft 40 is substantially stationary with respect to the water surface 42 and when the drive unit 35 is not tilted (i.e., is placed in the position shown in FIG. 1). The term "vertically" in turn means that portions, members or components extend generally normal to those that extend horizontally.

This type of engine, however, merely exemplifies one type of engine on which various aspects and features of the present invention can be suitably used. Engines having other numbers of cylinders, having other cylinder arrangements (V-shape, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A moveable member moves relative to the cylinder block 84 in a suitable manner. In the illustrated arrangement, a piston 90 reciprocates within each cylinder bore 86. A cylinder head member 92 is affixed to a rear end of the cylinder block 84 to close those ends of the cylinder bores 86 on this side. The cylinder head member 92 together with the associated pistons 90 and cylinder bores 86 preferably define four combustion chambers 96. Of course, the number of combustion chambers can vary, as indicated above.

A crankcase member 100 is affixed to the other end, i.e., a front end, of the cylinder block 84 to close those ends of the cylinder bores 86 on this side, and, together with the cylinder block 84, defines a crankcase chamber 102. A crankshaft 104 extends generally vertically through the crankcase chamber 102 and can be journalled for rotation about a rotational axis 106 by several bearing blocks. The rotational axis 106 of the crankshaft 104 preferably is on the longitudinal center plane 88. Connecting rods 108 couple the crankshaft 104 with the respective pistons 90 in a suitable manner. Thus, the reciprocal movement of the pistons 90 rotates the crankshaft 104. More specifically, the crankshaft 104 has four cranked portions that are angularly spaced with each other so that the pistons 90 move in a timed manner. The angular relationships between the respective cylinders will be described in detail below with reference to FIG. 5.

Preferably, the crankcase member 100 is located at the forward-most position of the engine 32, with the cylinder block 84 and the cylinder head member 92 being disposed rearward from the crankcase member 100 one after another. Generally, the cylinder block 84 (or individual cylinder bodies), the cylinder head member 92 and the crankcase member 100 together define an engine body 110. Preferably, at least these major engine portions 84, 92, 94, 100 are made of aluminum alloy. The aluminum alloy advantageously increases strength over cast iron while decreasing the weight of the engine body 110.

Figure 2:
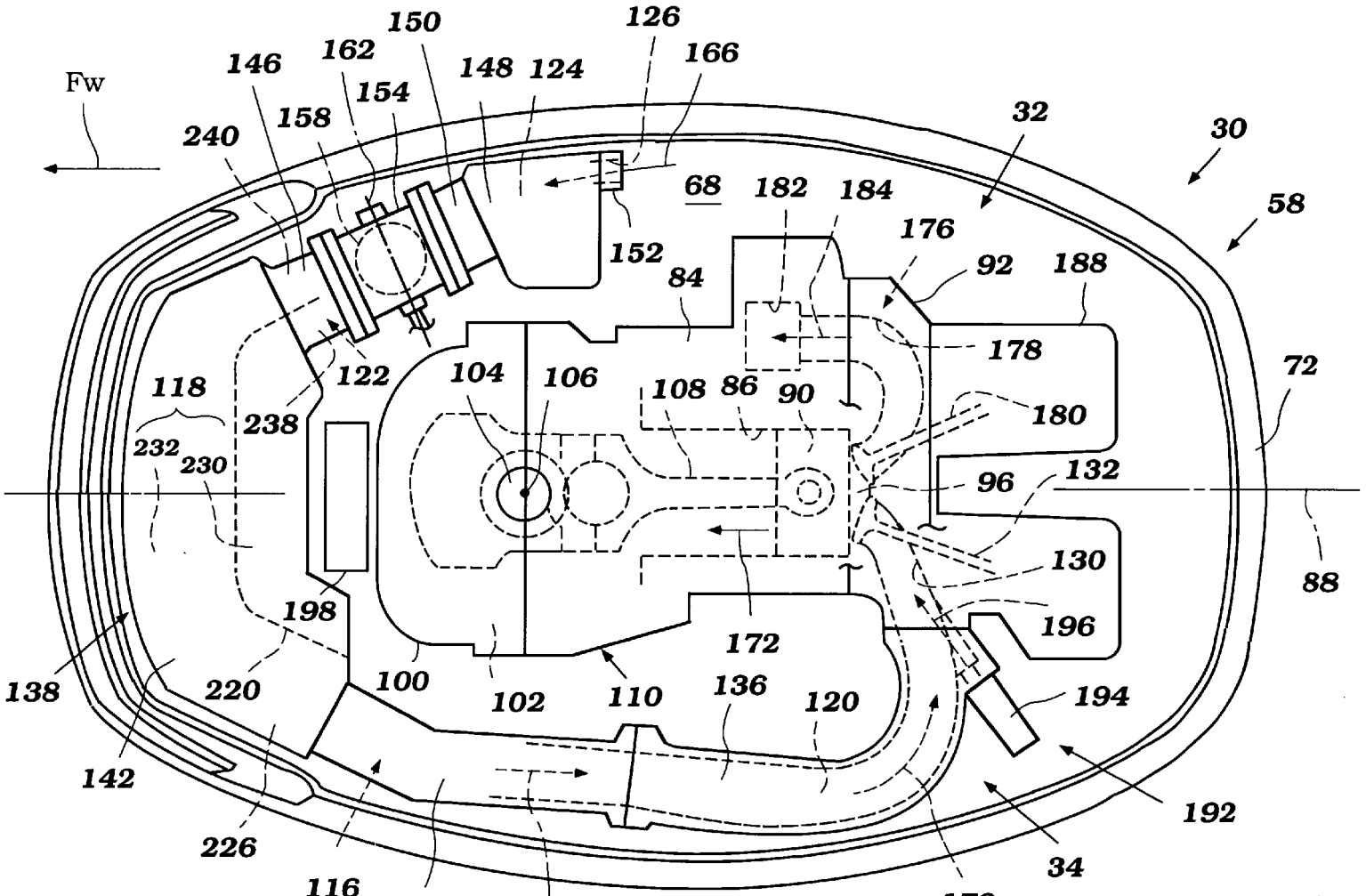
FIG. 2 is a top plan view of the outboard motor. A top cowling member is detached to show the engine including the air induction system.
Figure 3:
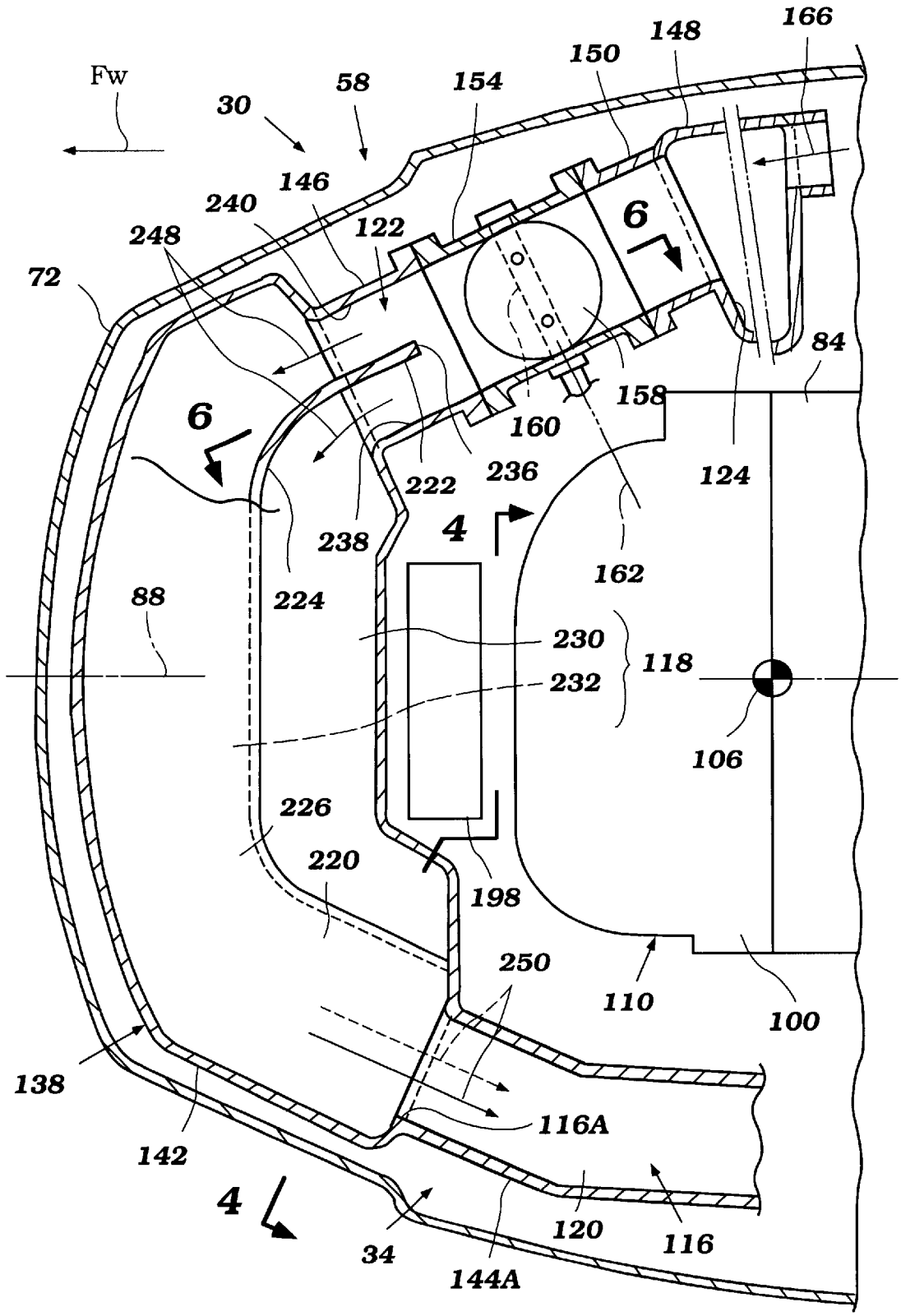
FIG. 3 is an enlarged top plan view of the outboard motor. The outboard motor except for an engine body of the engine is shown in section generally taken along the line 3—3 of FIG. 4.

With particular reference to FIGS. 2 and 3, the engine 32 also includes air induction system 34 which draws air from within the cavity 68 to the combustion chambers 96. In the embodiment shown, air induction system 34 includes four intake passages 116 and a plenum chamber 118 coupled with the intake passages 116. The plenum chamber 118 serves to coordinate or smooth airflow to the combustion chambers 96 and to reduce intake noise generated in the intake stroke. The intake passages 116 connect the plenum chamber 118 with the combustion chambers 96 and include outer intake passages 120 outside of the engine body 110. A single inlet passage 122 extends from the plenum chamber 118 oppositely to the outer intake passages 120. An upstream end of the inlet passage 122 includes a silencer chamber 124 whose volume can be smaller than the volume of the plenum chamber 118. The silencer chamber 124 has an inlet port 126 open to cavity 68 through which the air in the cavity 68 is introduced. The chamber 124 further reduces the intake noise and inhibits alien substances such as, for example, water splash from entering the inlet passage 122. The internal structure of the plenum chamber section 142 and related structure will be described in greater detail below with primary reference to FIGS. 3–5.

The intake passages 116 include, at their downstream ends, a set of inner intake passages 130 within the cylinder head member 92. These passages 130 communicate with the combustion chambers 96 through intake ports within the cylinder head member 92. Typically, each combustion chamber 96 has one or more intake ports. Intake valves 132 are slideably disposed in the cylinder head member 92 to move between an open position and a closed position. As such, the intake valves 132 act to open and close the intake ports to control the flow of air into the combustion chambers 96. Typically, biasing members such as, for example, springs are used to urge the intake valves 132 toward the respective closed positions by acting between a mounting boss formed on each cylinder head member 92 and a corresponding retainer that is affixed to each of the intake valves 132. When the intake valves 132 are in the open position, the inner intake passages 130 communicate with the associated combustion chambers 96.

Runner members 136 extending from the cylinder head member 92 provide downstream portions of the respective outer intake passages 126. Advantageously, a unitary chamber and conduit member 138 provide the plenum chamber 118, upstream portions of the respective outer intake passages 120 and a downstream portion of the inlet passage 122. In other words, plenum chamber section 142, runner sections 144 and inlet conduit section 146 are shown advantageously unitarily formed by member 138. Alternatively, it will be apparent that these sections 142, 144, 146 can be formed as individual members. A silencer member 148 advantageously forms the silencer chamber 124, inlet conduit section 150 and inlet port section 152. The inlet port section 152 forms the inlet port 126. The inlet conduit sections 146, 150 interpose a throttle body 154 therebetween to complete the inlet passage 122 together with the throttle body 154.

The illustrated runner members 136, the unitary member 138, the throttle body 154 and the silencer member 148 are preferably are made of plastic in any conventional manner such as, for example, an injection molding. Other materials such as, for example, aluminum alloy and other methods such as, for example, a die-casting method can be applied to form those members 136, 138, 154, 148. Appropriate fasteners such as, for example, bolts can be used to affix the members 136, 138, 154, 148 with each other.

The plenum chamber section 142 is located generally forwardly of the engine body 110, specifically, in front of the crankcase member 100 on the center plane 88. The runner members 136 extend generally laterally from the cylinder head member 92 on the port side and curves generally forwardly along the engine body 110. The runner sections 144 of the unitary member 138 are coupled with the runner members 136 to extend further toward the plenum chamber section 142. The inlet conduit section 146 extends generally rearwardly from the plenum chamber section 142 on the starboard side. The throttle body 154 and the silencer member 148 further extend rearwardly along the engine body 110 in this order. The inlet port section 152 is positioned most-rearwardly to direct the inlet port 126 rearwardly within the cavity 68.

The throttle body 154 preferably contains a throttle valve 158. Preferably, the throttle valve 158 is a butterfly valve that has a valve shaft 160 (FIG. 3) journalled for pivotal movement about a generally horizontal pivot axis 162. The valve shaft 160 preferably is connected with a control linkage that can be connected to an operational member such as, for example, a throttle lever provided on the watercraft 40 or otherwise proximate the operator of the watercraft 40. The operator can control the opening degree, i.e., angular position, of the throttle valve 158 through the control linkage. The throttle valve 158 can regulate or measure an amount of air that flows through the induction system 34 to the combustion chambers 96 in response to the operation of the operational member by the operator. Normally, the greater the opening degree, the higher the rate of airflow and the higher the engine speed.

With reference to FIG. 2, in general, the air within the closed cavity 68 is drawn into the silencer chamber 124 through the inlet port 126 as indicated by the arrow 166. The throttle valve 158 measures an amount of the air by an opening degree thereof. The air enters the plenum chamber 118 and is smoothed therein. The air further proceeds the respective outer intake passages 120 toward the inner intake passages 130 as indicated by the arrows 168, 170. While the intake valves 132 are placed in the open position and the pistons 90 are moving toward the crankcase chamber 102 as indicated by the arrow 172, the air enters the combustion chambers 96. Actually, the airflow to the combustion chambers 96 is made by negative pressure generated in the combustion chambers 96 with the movement of the pistons 90 in the direction of the arrow 172. This is an intake stroke of each cylinder. The engine 32 makes the intake stroke in every cylinder but with a certain interval from one to another. The respective intake strokes and relationships therebetween will be described in greater detail below with primary reference to FIGS. 4 and 5.

With reference to FIG. 2, the engine 32 further comprises an exhaust system 176 that routes burnt charges, i.e., exhaust gases, to a location outside of the outboard motor 30. The cylinder head member 92 defines a set of inner exhaust passages 178 that communicate with the combustion chambers 96 through one or more exhaust ports defined in the inner surface of the cylinder head member 92. The exhaust ports can be selectively opened and closed by exhaust valves 180. The construction of each exhaust valve and the arrangement of the exhaust valves are substantially the same as the intake valve and the arrangement thereof, respectively. Thus, further description of these components is deemed unnecessary.

An exhaust manifold 182 preferably is defined within the cylinder block 84 and extends generally vertically along a bank of the cylinder bores 86. The exhaust manifold 182 communicates with the combustion chambers 96 through the inner exhaust passages 178 and the exhaust ports to collect exhaust gases therefrom as indicated by the arrow 184. The exhaust manifold 182 is coupled with the exhaust discharge passage of the exhaust guide member 80. When the exhaust ports are opened, the combustion chambers 96 communicate with the exhaust discharge passage through the exhaust manifold 182.

A valve cam mechanism (not shown) preferably is provided for actuating the intake and exhaust valves 132, 180. Preferably, the valve cam mechanism includes one or more camshafts extend generally vertically and are journalled for rotation on and within a cylinder head cover member 188. The camshafts have cam lobes to push valve lifters that are affixed to the respective ends of the intake and exhaust valves 132, 180 in any suitable manner. The cam lobes repeatedly push the valve lifters in a timed manner, which is in proportion to the engine speed. The movement of the lifters generally is timed by rotation of the camshafts to appropriately actuate the intake and exhaust valves 132, 180.

A camshaft drive mechanism (not shown) preferably is provided for driving the valve cam mechanism. The intake and exhaust camshafts are provided with intake and exhaust driven sprockets positioned atop the intake and exhaust camshafts, respectively, while the crankshaft 104 has a drive sprocket positioned atop thereof. A timing chain or belt is wound around the driven sprockets and the drive sprocket. The crankshaft 104 thus drives the respective camshafts through the timing chain in the timed relationship. Because the camshafts must rotate at half of the speed of the rotation of the crankshaft 104 in a four-cycle engine, a diameter of the driven sprockets is twice as large as a diameter of the drive sprocket.

The engine 32 preferably has indirect, port or intake passage fuel injection system 192. The fuel injection system 192 preferably comprises four fuel injectors 194 with one fuel injector allotted for each one of the respective combustion chambers 96. Preferably, the fuel injectors 194 are mounted on the most-downstream portions of the runner members 136, and a fuel rail connects the respective fuel injectors 194 with each other. The fuel rail also defines a portion of fuel conduits to deliver fuel to the injectors 194.

Each fuel injector 194 preferably has an injection nozzle directed to the inner intake passage 130. The fuel injectors 194 spray fuel into the passages 130, as indicated by the arrow 196 of FIG. 2, under control of an electronic control unit (ECU) 198 for combustion in the combustion chambers 96. The fuel injectors 194 are connected to the ECU 198 through appropriate control lines. The ECU 198 controls both the initiation timing and the duration of the fuel injection cycle of the fuel injectors 194 so that the nozzles spray a proper amount of fuel each combustion cycle. The illustrated ECU 198 is disposed in a space formed between the engine body 110 and the plenum chamber section 142 of the unified member 138, and is mounted on the engine body 110 or the unified member 138. Otherwise, one or more stays can extend from a bottom of the lower cowling member 72 to support the ECU 198.

Typically, a fuel supply tank disposed on a hull of the associated watercraft 40 contains the fuel. The fuel is delivered to the fuel rail through the fuel conduits and at least one fuel pump, which is arranged along the conduits. The fuel pump pressurizes the fuel to the fuel rail and finally to the fuel injectors 194. A vapor separator preferably is disposed along the fuel conduits to separate vapor from the fuel. A direct fuel injection system that sprays fuel directly into the combustion chambers can replace the indirect fuel injection system described above. Instead, any other charge forming devices, such as carburetors, can be used.

The engine 32 further comprises an ignition or firing system (not shown). Each combustion chamber 96 is provided with a spark plug which preferably is disposed between the intake and exhaust valves 132, 180. Each spark plug has electrodes that are exposed into the associated combustion chamber 96 and that are spaced apart from each other with a small gap. The spark plugs are connected to the ECU 198 through appropriate control lines and ignition coils. The spark plugs generate a spark between the electrodes to ignite an air/fuel charge in the combustion chamber 96 at selected ignition timing under control of the ECU 198.

The illustrated ECU 198 controls at least the fuel injection system 176 and the ignition system based upon signals sent from sensors through sensor lines. For use by the ECU 198, the engine 32 may have various sensors such as, for example, a crankshaft angle position sensor, an air intake pressure sensor and a throttle valve position sensor. Of course, other sensors are available and the sensors can be selected in accordance with control strategies planned for the ECU 198. Typically, the ECU 198 has control maps or functional equations to practice the control strategies.

The engine 32 of course can comprise other systems, devices, components and members. For example, a water cooling system and a lubrication system can be provided. These systems, devices, components and members are conventional and further descriptions on them are deemed unnecessary.

In the illustrated engine 32, the pistons 90 reciprocate between top dead center and bottom dead center. When the crankshaft 104 makes two rotations, the pistons 90 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 90, the camshafts make one rotation and actuate the intake and exhaust valves 132, 180 to open the intake and exhaust ports during the intake stroke and the exhaust stroke, respectively.

Generally, during the intake stroke, air is drawn into the combustion chambers 96 through the air induction system 34 and fuel is injected into the inner intake passages 130 by the fuel injectors 194. The air and the fuel thus are mixed to form the air/fuel charge in the combustion chambers 96. The air/fuel ratio is generally held in the optimum condition under control of the ECU 198 by determining an amount of the fuel in corresponding to an amount of the air. Slightly before or during the power stroke, the respective spark plugs ignite the compressed air/fuel charge in the respective combustion chambers 96. The air/fuel charge thus rapidly burns during the power stroke to move the pistons 90. The burnt charge, i.e., exhaust gases, then are discharged from the combustion chambers 96 during the exhaust stroke. The combustion cycles proceed per cylinder and the combustion cycles of each cylinder occur in due order that has been predetermined.

With reference back to FIG. 1, the driveshaft housing 62 is positioned below the exhaust guide member 80 to support a driveshaft 200 which extends generally vertically through the driveshaft housing 62. The driveshaft 200 is journalled for rotation in the driveshaft housing 62 and is driven by the crankshaft 104. The driveshaft housing 62 preferably defines an internal section of the exhaust system 176 that leads the majority of exhaust gases to the lower unit 64. The internal section preferably includes an idle discharge portion that is branched off from a main portion of the internal section to discharge idle exhaust gases directly out to the atmosphere in idle speed of the engine 32 through a discharge port that preferably is formed on a rear surface of the driveshaft housing 62.

The lower unit 64 depends from the driveshaft housing 62 and supports a propulsion shaft 206 that is driven by the driveshaft 200. The propulsion shaft 206 extends generally horizontally through the lower unit 64 and is journalled for rotation. A marine propulsion device is attached to the propulsion shaft 206. In the illustrated arrangement, the propulsion device is a propeller 208 that is affixed to an outer end of the propulsion shaft 206. The propulsion device, however, can take the form of a dual counter-rotating system, a hydrodynamic jet, or any of a number of other suitable propulsion devices.

A transmission 210 preferably is provided between the driveshaft 200 and the propulsion shaft 206, which lie generally normal to each other (i.e., at a 90° shaft angle) to couple together the two shafts 200, 206 by bevel gears. The outboard motor 30 has a clutch mechanism that allows the transmission 210 to change the rotational direction of the propeller 208 among forward, neutral or reverse.

The lower unit 64 also defines an internal section of the exhaust system 176 that is connected with the internal exhaust section of the driveshaft housing 62. At engine speeds above idle, the exhaust gases generally are discharged to the body of water surrounding the outboard motor 30 through the internal sections and then a discharge section defined within the hub of the propeller 208. Additionally, the exhaust system 176 can include a catalytic device at any location in the exhaust system 176 to purify the exhaust gases.

The Air Induction System

With reference still to FIGS. 2 and 3, and additionally with reference to FIGS. 4–7, the construction of the preferred embodiment of the air induction system 34 will now be described in greater detail below.

Figure 5:
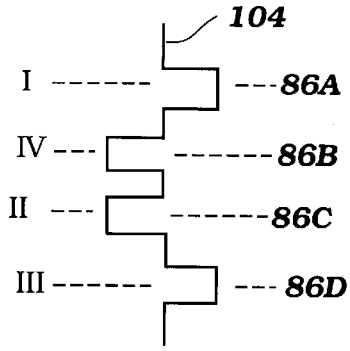
FIG. 5 is a schematic view of a crankshaft structure of the engine and an ignition order in connection with the crankshaft structure.

With reference to FIG. 5, the crankshaft 104 has four cranked portions that are angularly spaced with each other as described above. In the illustrated embodiment, the angle is basically 180 degrees. That is, the crankshaft portion corresponding to the cylinder 86B is angularly spaced 180 degrees from the crankshaft portion corresponding to the cylinder 86A. The crankshaft portion corresponding to the cylinder 86C is not angularly spaced from the crankshaft portion corresponding to the cylinder 86B and thus is formed in the same phase. The crankshaft portion corresponding to the cylinder 86D in turn is angularly spaced 180 degrees from the crankshaft portion corresponding to the cylinder 86C and thus is formed in the same phase as the crankshaft portion corresponding to the cylinder 86A. The preferred firing or ignition order applied to this arrangement cylinder 86A, cylinder 86C, cylinder 86D, and cylinder 86B as indicated by the order of the Roman numerals I, II, III, IV, such that each successive firing of the ignition coincides with a 180° phase rotation of the crankshaft. All of the crankshaft portions are displaced 180 degree with one another. This means that the intake stroke of the cylinder 86C starts 180 degrees later in the rotation of the crankshaft 104 than the intake stroke of the cylinder 86A. Cylinders 86D, 86B continue with the same angular lag from the respective previous intake strokes.

Similarly, the ignition order can be 86A, 86B, 86D and then 86C. In this alternative, the order of the intake strokes also is 86A, 86B, 86D and 86C.

Figure 6:
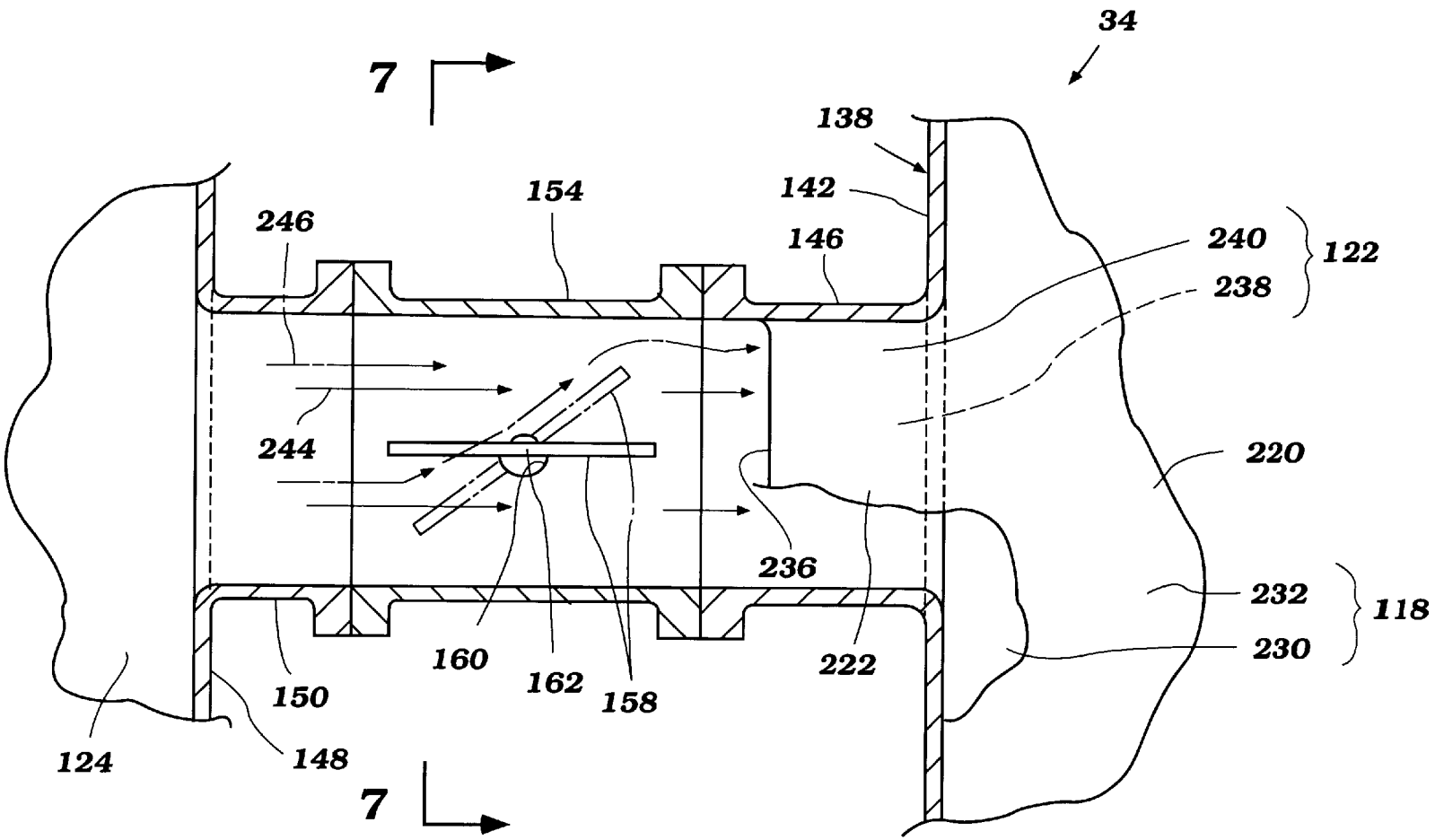
FIG. 6 is a sectional side view of the air induction system taken along the line 6—6 of FIG. 3 to show an intake passage of the induction system that includes a throttle valve therein.

A significant feature of the preferred embodiments of the air induction system is an improved engine torque characteristic. This is accomplished by effectively preventing the previously generated positive pressure wave from having a detrimental influence. Referring to FIGS. 3 and 6, the illustrated plenum chamber section 142 has a partition 220, and the inlet conduit section 146 also has a partition 222 which preferably is formed contiguously with the partition 220.

Figure 4:
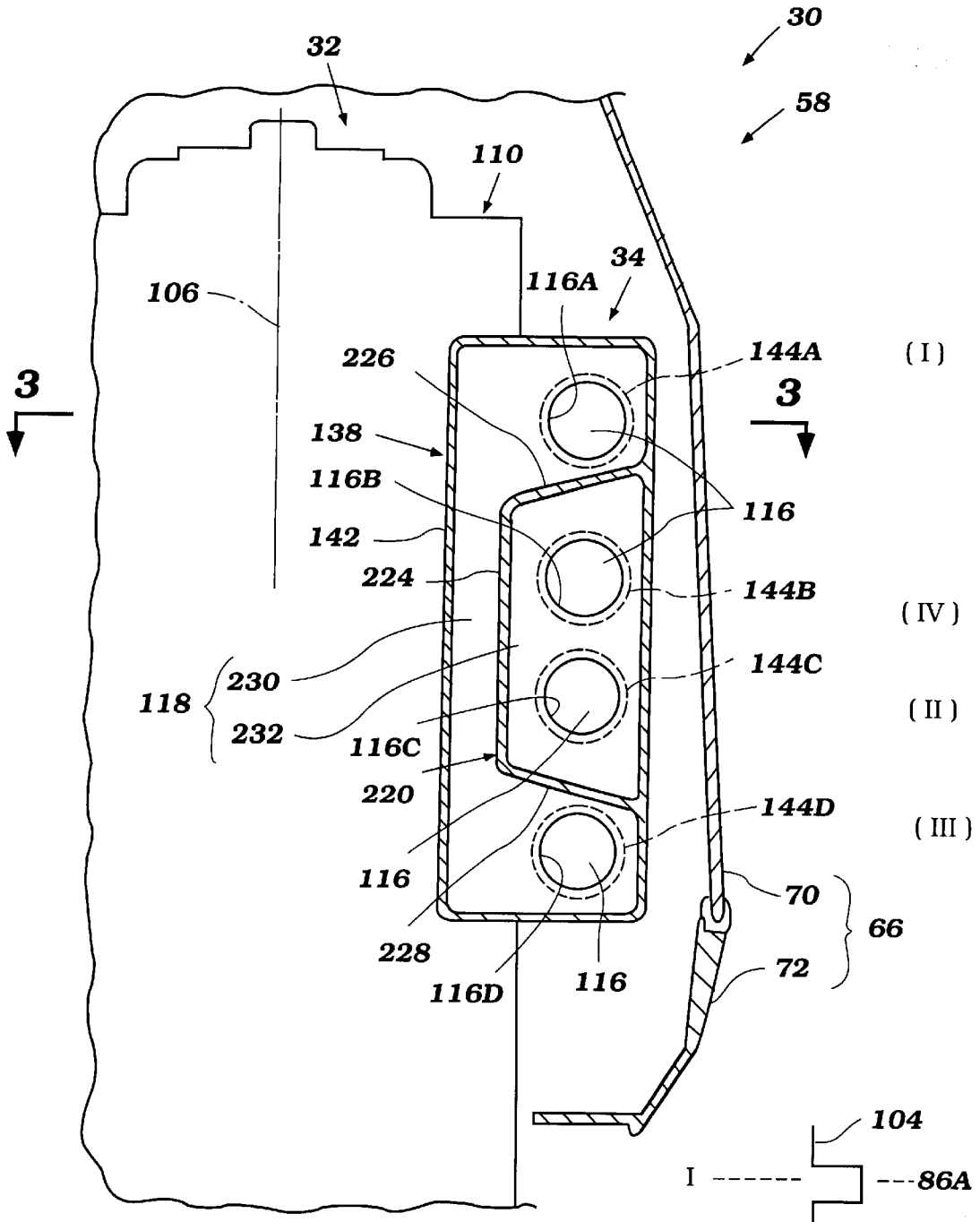
FIG. 4 is a sectional view of the air induction system taken along the line 4—4 of FIG. 3.
Figure 7:
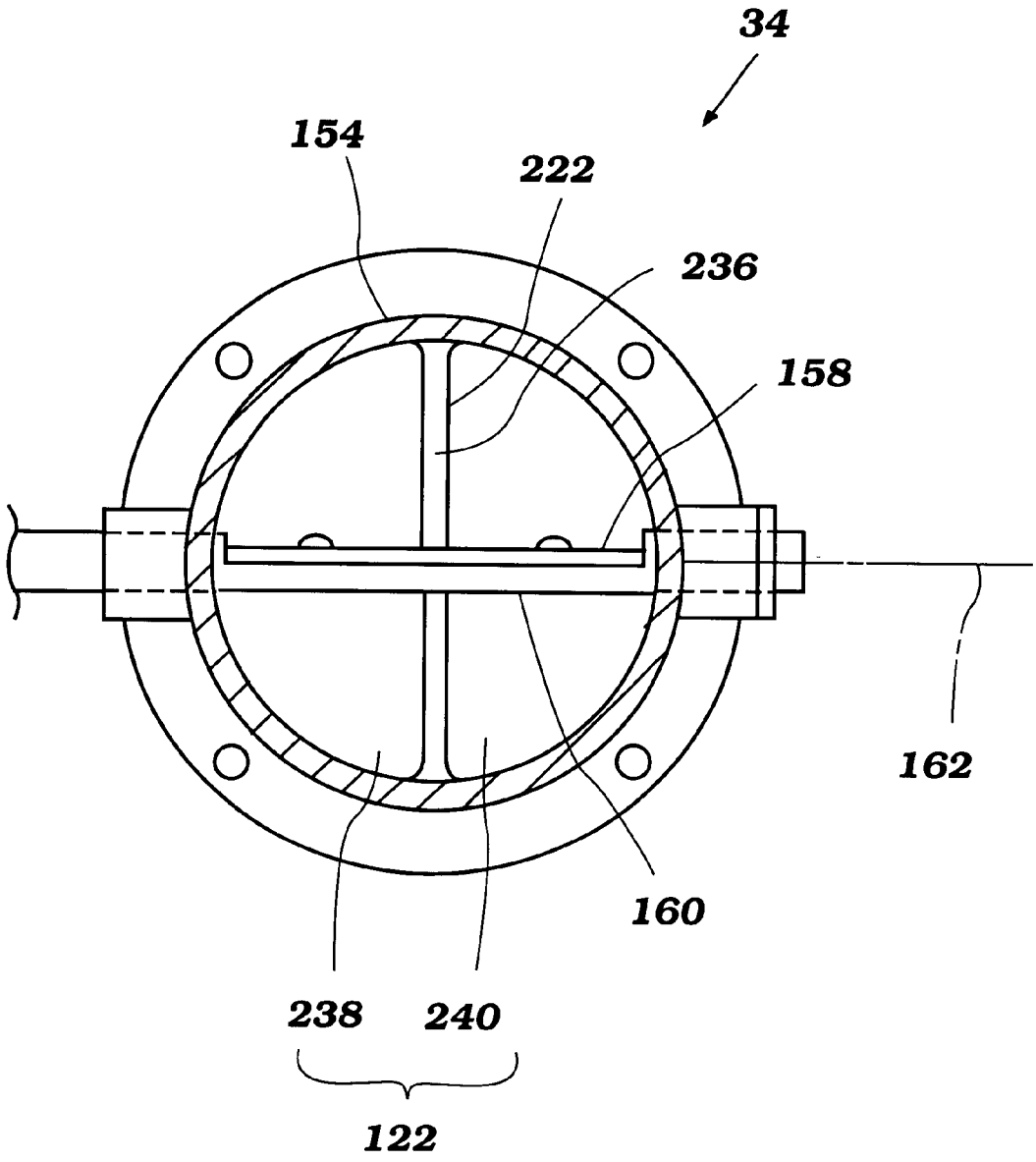
FIG. 7 is a sectional view of the intake passage taken along the line 7—7 of FIG. 6.

Referring to FIGS. 3, 4 and 7, the partition 220 of the plenum chamber section 142 comprises a vertical section 224 and upper and lower generally horizontal sections 226, 228 (see FIG. 4) that connect the vertical section 224 with an internal surface of the plenum chamber section 142. The plenum chamber 118 is divided into two sub-chambers 230, 232. Both the sub-chambers 230, 232 preferably have substantially equal volume. Assigning the reference numerals 144A, 144B, 144C and 144D to the runner sections 144 corresponding to the cylinders 86A, 86B, 86C and 86D, respectively, and also assigning the reference numerals 116A, 116B, 116C and 116D to end portions of the intake passages 116 corresponding to the cylinders 86A, 86B, 86C and 86D, respectively, the runner sections 144A, 144D are coupled with the sub-chamber 230 at end portions 116A, 116D of the intake passages 116, while the runner sections 114B, 114C are coupled with the sub-chamber 232 at the end portions 116B, 116C. That is, the intake passages 116 are categorized to divide into two groups so that one group includes the intake passages 116 corresponding to the runner sections 144A, 144D and the other group includes the intake passages 116 corresponding to the runner sections 144B, 144C. The former group is coupled with the sub-chamber 230, while the latter group is coupled with the sub-chamber 232. This is because the cylinders 86A, 86D have discontinuity in the ignition order with each other, while the cylinders 86B, 86C also have discontinuity in the ignition order with each other. In other words, the air that sequentially flows through the runner sections 144A, 144C (or 144D, 144B) is only allowed to pass through different chamber sections, i.e., either the sub-chamber 230 or the sub-chamber 232. Because the intake strokes of the cylinders 86A, 86C or the intake strokes of the cylinders 86D, 86B are angularly separated 180 degrees from each other and these separations are sufficient enough for the previous positive wave to fade out, any detrimental influence of such a previous positive pressure wave can be effectively excluded. Thus, for example, the positive pressure wave generated by the intake stroke of cylinder 86A is prevented from inhibiting the airflow of cylinder 86C and the positive pressure wave generated by the intake stroke of cylinder 86C is prevented from inhibiting the airflow of cylinder 86D.

The partition 220 is useful not only for separating the airflow but also for reinforcing the plenum chamber section 142. The plenum chamber section 142 generally is a relatively weak portion in strength due to defining a relatively large hollow therein. The partition 220, however, can provide some strength to the chamber section 142 without requiring additional costs.

The partition 222 of the conduit section 146 has a vertical configuration that contiguously extends from the vertical section 224. With reference to FIGS. 3 and 7, the partition 222 has an end portion 236 that extends generally normal to the horizontal pivot axis 162 at generally the center of the inlet passage 122 to divide the inlet passage 122 into two sub-passages 238, 240. This arrangement is advantageous because the air can be uniformly distributed to both the sub-passages 238, 240 that are connected with the sub-chambers 230, 232 of the plenum chamber 118, respectively.

The air coming from the silencer chamber 124 proceeds as indicated by the solid arrows 244 of FIG. 6 if the throttle valve 158 is in generally the fully open position, or proceeds as indicated by the phantom arrows 246 of FIG. 6 if the throttle valve 158 is partially open position, both toward the partition 222. The air then is divided into the sub-passages 238, 240 and the divided air portions move to the sub-chambers 230, 232 as indicated by the arrows 248 of FIG. 3. The respective air portions are further distributed to the respective intake passages 116 as indicated by the arrows 250 of FIG. 3 to proceed toward the associated combustion chambers 96. The movement of the air is made by the negative pressure generated by the movement of the pistons 90. The negative pressure that makes the pulsation wave does not inhibit the airflow of the next intake stroke of another cylinder from moving forward to the combustion chamber 96, since, as described, sequential air flows alternate through different sub-chambers 230, 232. No detrimental influence from another airflow can thus occur.

Figure 8:
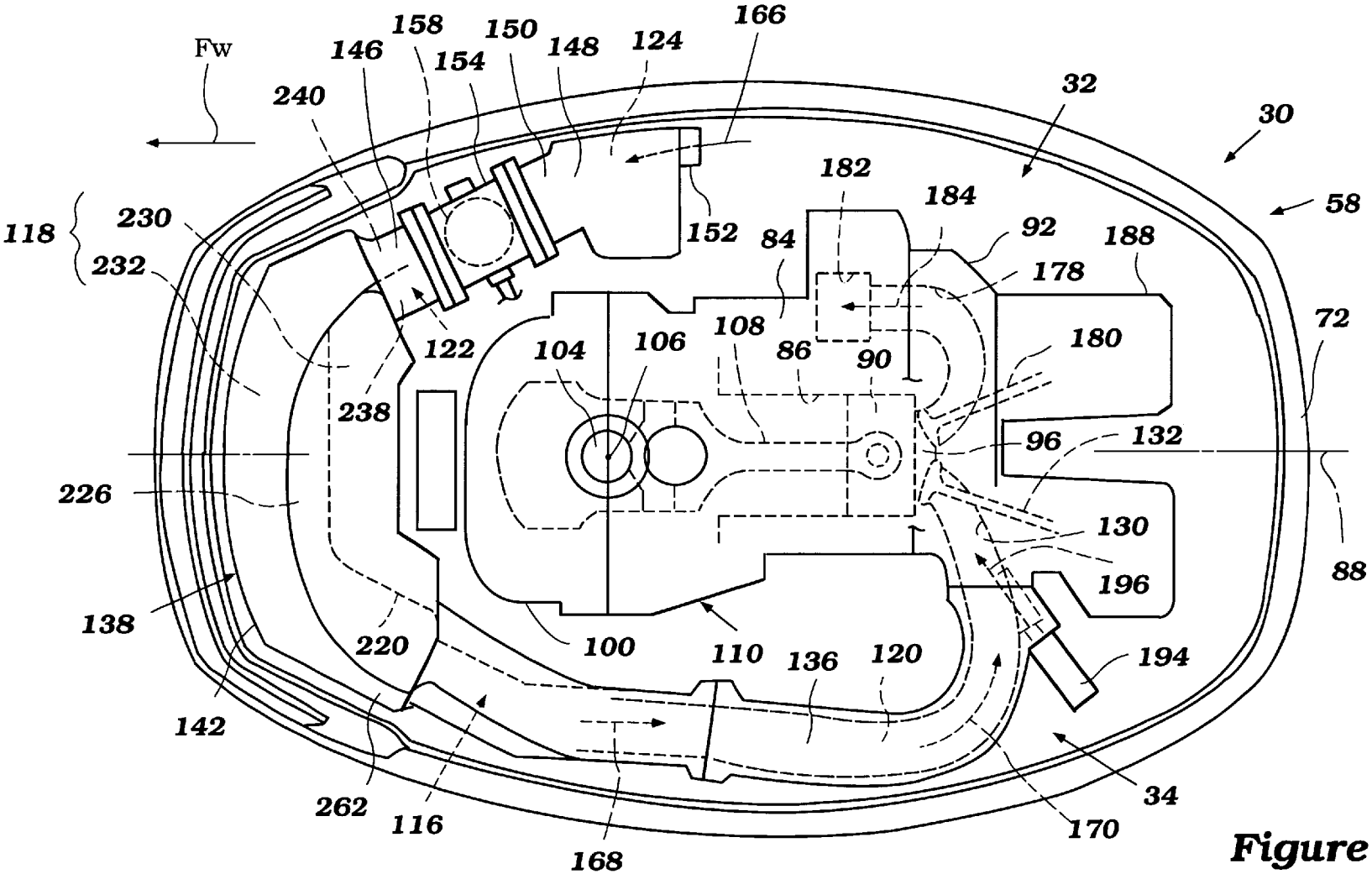
FIG. 8 is a top plan view of the outboard motor to show a modification of the air induction system.
Figure 9:
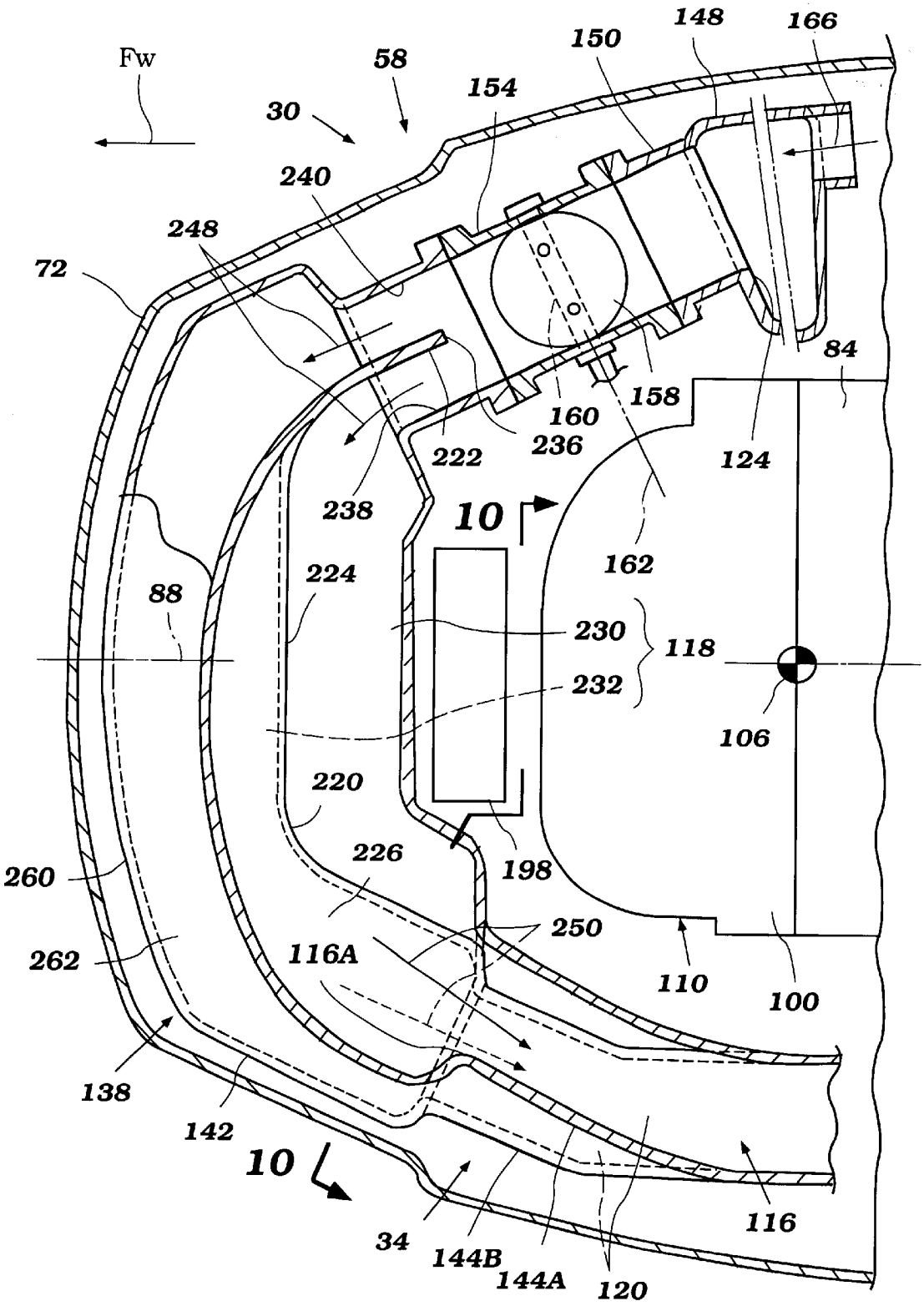
FIG. 9 is an enlarged top plan view showing the outboard motor of FIG. 8. The outboard motor except for an engine body is shown in section generally taken along the line 9—9 of FIG. 10.
Figure 10:
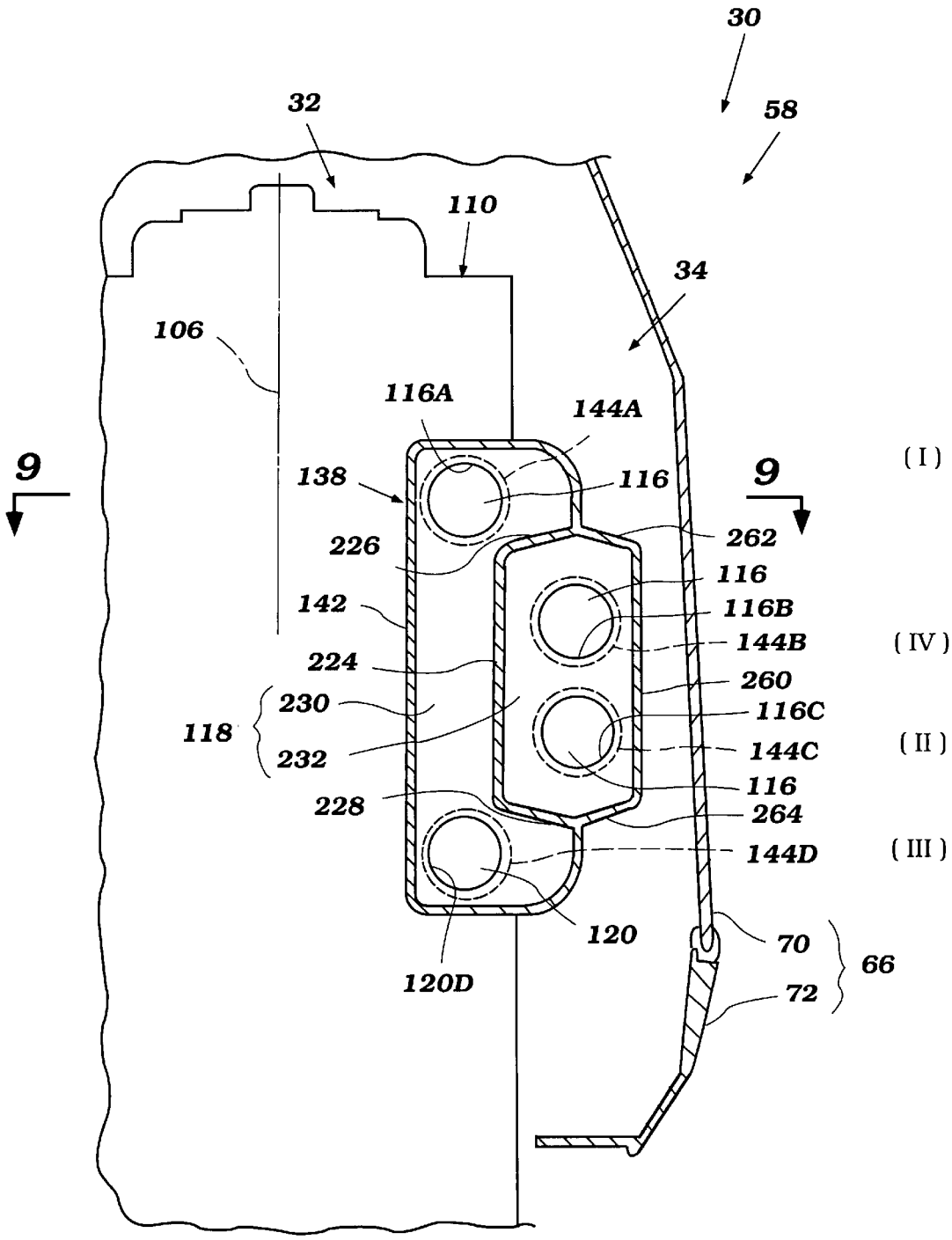
FIG. 10 is a sectional view showing the air induction system of FIG. 8 taken along the line 10—10 of FIG. 9.

FIGS. 8–10 illustrates a modification of the air induction system. The components and members that have already been described are assigned with the same reference numerals and will not be described repeatedly.

In this modified arrangement, the sub-chamber 232 is offset laterally outwardly from the sub-chamber 230 in comparison with the arrangement shown in FIGS. 1–7. That is, although the partition 220 having the vertical section 224 and the upper and lower horizontal sections 226, 228 is still provided, the upper and lower horizontal sections 226, 228 are slightly shorter than those in the first arrangement. Instead, a portion of the outer wall 260 next to the sub-chamber 232 is shifted laterally outwardly to place the sub-chamber 232 farther from the engine body 110 than the sub-chamber 232 in the first arrangement. Outer upper and lower horizontal sections 262, 264 thus inevitably extend outwardly in this arrangement. As a result, the sub-chamber 230 can be wider laterally than the sub-chamber 230 in the first arrangement. In other words, the upper and lower portions of the sub-chamber 230 are not separated from each other by a relatively narrow channel therebetween. More specifically, as best shown in FIG. 10, the end portions 120A, 120D of the intake passages 116 face with each other because the partition 220 is offset outwardly in this arrangement. This is advantageous because any detrimental influence between the upper and lower portions of the sub-chamber 230 can effectively be inhibited from occurring. Additionally, because of the offset arrangement of the sub-chamber 232, the vertical length of the plenum chamber section 142 can be shorter than the length thereof in the first arrangement.

It should be noted that various chamber section arrangements other than those described above can be applied. For instance, both the sub-chambers 230, 232 can be arranged vertically as such, for example, that the end portions 116A, 116D of the intake passages 116 are positioned above or below the sub-chamber 232. It also should be noted that the sub-chambers 230, 232 can be formed as two plenum chambers with separate and discrete chamber members. In this alternative, the intake passages 116 can be coupled with the respective plenum chambers in accordance with the same rule described above, and the inlet passage 122 can bifurcate to be coupled with both the plenum chambers.

Of course, the foregoing description is that of preferred constructions having certain features, aspects and advantages in accordance with the present invention. Various changes and modifications may be made to the above-described arrangements without departing from the spirit and scope of the invention, as defined by the appended claims. For instance, the throttle valve can be positioned downstream of the plenum chamber section or in the plenum chamber section. The silencer member can be omitted if the plenum chamber can sufficiently reduce intake noise and any filter device can remove alien substances.

What is claimed is:

1. An internal combustion engine having a plurality of combustion chambers which are ignited in a predetermined order, in which the previously generated positive pressure wave does not inhibit the flow of air during the intake stroke of the next-to-fire combustion chamber, said engine comprising:

a plurality of intake passages respectively coupled to said combustion chambers; and a plenum chamber having first and second sub-chambers with one of said sub-chambers coupled to a first group of said intake passages and the other of said sub-chambers connected to a second group of said intake passages;

said predetermined ignition order resulting in intake strokes within said combustion chambers alternating between the combustion chambers coupled to said first sub-chamber and the combustion chambers coupled to said second sub-chamber so that intake strokes in the combustion chamber are prevented from inhibiting the flow of air into the next-to-fire combustion chamber, said first group of the intake passages having end portions connected to said one of the sub-chambers, said second group of the intake passages having end portions connected to the other sub-chamber, and the end portions of the first group of the intake passages being positioned farther from the body of said engine than the end portions of the second group of intake passages.

2. A method of delivering intake air to an internal combustion engine comprising:

forming a partition in a plenum chamber to define first and second chambers such that said second chamber is positioned farther from a body of the engine than said first chamber;

coupling said first plenum chamber to intake passages of a first group of combustion chambers; and coupling said second plenum chamber to intake passages of a second group of combustion chambers.

3. An internal combustion engine comprising an engine body, a plurality of moveable members moveable relative to the engine body, the engine body and the moveable members together defining a plurality of combustion chambers, and an air induction system arranged to introduce air into the combustion chambers, the air induction system including a plurality of intake passages corresponding to the respective combustion chambers, the intake passages arranged next to each other, a plenum chamber coupled with the intake passages, the plenum chamber being divided into a first sub-chamber and a second sub-chamber, a first group of the intake passages communicating with the first sub-chamber and a second group of intake passages communicating with the second sub-chamber, at least one intake passage of the second group of intake passages being at least partially disposed between at least two intake passages of the first group of intake passages.

4. The engine as set forth in claim 3, wherein the air induction system includes a partition to divide the plenum chamber.

5. The engine as set forth in claim 3, wherein the engine operates on a four-cycle combustion principle.

6. The engine as set forth in claim 3, wherein the engine powers a marine propulsion device.

7. The engine as set forth in claim 3, wherein the intake passages of the first group have first end portions that are connected with the first sub-chamber, the intake passages of the second group have second end portions that are connected with the second sub-chamber, and the first end portions are positioned farther from the engine body than the second end portions.

8. An internal combustion engine comprising an engine body, a plurality of moveable members moveable relative to the engine body, the engine body and the moveable members together defining a plurality of combustion chambers, and an air induction system arranged to introduce air into the combustion chambers, the air induction system including a plurality of intake passages corresponding to the respective combustion chambers, a plenum chamber coupled with the intake passages, the air being delivered to each one of the combustion chambers from the plenum chamber through each one of the intake passages in a predetermined order, said plenum chamber being divided into a plurality of sub-chambers, the air induction system additionally including an air inlet passage extending upstream of the plenum chamber, at least the most-downstream portion of the air inlet passage being divided into a plurality of sub-passages, each sub-passage being contiguously coupled with a respective one of the sub-chambers.

9. The engine as set forth in claim 8, wherein the air induction system includes a partition dividing the plenum chamber into the sub-chambers and contiguously dividing the inlet passage into the sub-passages.

10. The engine as set forth in claim 8, wherein the air induction system includes a partition dividing the air inlet passage into the sub-passages, and a throttle valve disposed in the air inlet passage for pivotal movements about a pivot axis, the partition has an end portion extending generally normal to the pivotal axis of the throttle valve.

11. The engine as set forth in claim 10, wherein the end portion extends generally at the center of the inlet passage.

12. The engine as set forth in claim 8, wherein the air induction system includes a throttle valve disposed in the inlet passage.

13. The engine as set forth in claim 8, wherein the air induction system includes an intake silencer upstream of the inlet passage.

14. An internal combustion engine comprising an engine body, at least four moveable members moveable relative to the engine body, the engine body and the moveable members together defining at least four combustion chambers, and an air induction system arranged to introduce air into the combustion chambers, the air induction system including at least four intake passages corresponding to the respective combustion chambers, the intake passages being disposed next to one another, and a plenum chamber coupled with the intake passages, the plenum chamber being divided into at least first and second sub-chamber, the intake passages being categorized into first and second groups, each one of the groups including two of the intake passages which each lie next to an intake passage of another group, the intake passages of the first group being connected with the first sub-chamber, the intake passages of the second group being connected with the second sub-chamber.

15. The engine as set forth in claim 14, wherein the air induction system includes an air inlet passage extending upstream of the plenum chamber.

16. An internal combustion engine comprising an engine body, a plurality of moveable members moveable relative to the engine body, the engine body and the moveable members together defining a plurality of combustion chambers, and an air induction system arranged to introduce air into the combustion chambers, the air induction system including a plurality of intake passages corresponding to the respective combustion chambers, and first and second plenum chambers coupled with the intake passages, the intake passages being categorized into first and second groups, the first group being connected with the first plenum chamber, and the second group being connected with the second plenum chamber, the first group having at least one intake passages that is arranged on the engine such that at least a portion of the one intake passage is interposed between two intake pages of the second group.

17. The engine as set forth in claim 16, additionally comprising an inlet passage coupled with the first and second plenum chambers upstream of the plenum chambers.

18. Th engine as set forth in claim 17, wherein the air induction system includes a throttle valve disposed in the inlet passage.

19. An internal combustion engine comprising an engine body, a plurality of moveable members moveable relative to the engine body, the engine body and the moveable members together defining a plurality of combustion chambers, and an air induction system arranged to introduce air into the combustion chambers, the air induction system including a plurality of intake passages corresponding to the respective combustion chambers, a plenum chamber coupled with the intake passages, the air being delivered to each one of the combustion chambers from the plenum chamber through each one of the intake passages in a preset order, the plenum chamber being entirely divided into two sub-chambers so as to inhibit air flow between the sub-chambers, and the intake passages being connected to the sub-chambers in a manner that alternates air being drawn from each sub-chamber.

20. The engine as set forth in claim 19, wherein the air induction system includes an air inlet passage extending upstream of the plenum chamber, at least the most-downstream portion of the air inlet passage is divided into two sub-passages, and each one of the sub-passages are contiguously coupled with each one of the sub-chambers.

21. The engine as set forth in claim 20, wherein the air induction system includes a partition dividing the plenum chamber into the sub-chambers and also contiguously dividing the inlet passages into the sub passages.

22. An internal combustion engine comprising an engine body, at least four moveable members moveable relative to the engine body, the engine body and the moveable members together defining at least four combustion chambers, and an air induction system arranged to introduce air into the combustion chambers, the air induction system including at least four intake passages corresponding to the respective combustion chambers, a plenum chamber coupled with the intake passages, the air being delivered to each one of the combustion chambers from the plenum chamber through each one of the intake passages in preset order, the plenum chamber being entirely divided into first and second sub-chambers so as to inhibit air flow between the sub-chambers, a first group of the intake passages being connected with the C first sub-chamber and a second group of the intake passages being connected with the other sub-chamber, whereby the preset order of air delivery through the intake passages alternates between using an intake passage of the first group and an intake passage of the second group.

23. An internal combustion engine comprising an engine body, a plurality of moveable members moveable relative to the engine body, the engine body and the moveable members together defining a plurality of combustion chambers, and an air induction system arranged to introduce air into the combustion chambers, the air induction system including a plurality of intake passages corresponding to the respective combustion chambers, a plenum chamber coupled with the intake passages, the air being delivered to each one of the combustion chambers from the plenum chamber through each one of the intake passages in a preset order, said plenum chamber being divided into at least two sub-chambers, one of the sub-chamber being positioned farther from the engine body than the other sub-chamber.

* * * * *